US008403590B2

(12) United States Patent
Hill

(10) Patent No.: US 8,403,590 B2
(45) Date of Patent: Mar. 26, 2013

(54) COUPLER

(76) Inventor: Ian Hill, County Down (GB)

( * ) Notice: Subject to any disclaimer, the term of this patent is extended or adjusted under 35 U.S.C. 154(b) by 168 days.

(21) Appl. No.: 12/908,304

(22) Filed: Oct. 20, 2010

(65) Prior Publication Data

US 2011/0243654 A1 Oct. 6, 2011

(30) Foreign Application Priority Data

Mar. 31, 2010 (GB) ..... 1005482.3
Jun. 18, 2010 (GB) ..... 1010269.7
Sep. 21, 2010 (GB) ..... 1015814.5

(51) Int. Cl.
*B25G 3/18* (2006.01)
*F16B 21/00* (2006.01)
*F16D 1/00* (2006.01)

(52) U.S. Cl. ..... 403/322.3; 403/322.1; 403/330; 414/723; 172/272; 37/468

(58) Field of Classification Search ..... 403/322.3, 403/324, 322.4, 321, 322.1, 330, 327; 37/468; 172/272, 273, 274, 275; 414/728, 723, 705
See application file for complete search history.

(56) References Cited

U.S. PATENT DOCUMENTS 1,085,964 A 2/1914 Briggs
2,056,006 A 9/1936 Hodgkins
2,932,282 A 1/1945 McKinley et al.
2,366,587 A 4/1960 Armington
4,577,885 A 3/1986 Breu
5,423,625 A * 6/1995 Gebauer et al. ..... 403/322.3
6,132,131 A 10/2000 Nakamura et al.
6,273,128 B1 8/2001 Paczonay
6,332,747 B1 12/2001 Lee
6,379,075 B1 4/2002 Shamblin et al.
6,422,805 B1 7/2002 Miller (Continued)

FOREIGN PATENT DOCUMENTS

FR 978531 4/1951
FR 1146273 11/1957

(Continued)

OTHER PUBLICATIONS

European Search Report for EP 4008658 mailed Aug. 19, 2004.

(Continued)

*Primary Examiner* — Daniel P. Stodola
*Assistant Examiner* — Matthew R McMahon
(74) *Attorney, Agent, or Firm* — Gardner, Linn, Burkhart & Flory, LLP

(57) ABSTRACT

A coupler for an excavator has first and second recesses for receiving first and second pins, respectively, of an attachment. A latching member is movable into and out of a latching state in which it closes the second pin-receiving recess. A blocking member is movable into and out of a blocking state in which it closes the first pin-receiving recess. An actuator is provided for moving the first latching member into and out of the latching state, the actuator acting indirectly upon the blocking member to move the blocking member into and out of its blocking state as the latching member is moved into and out of its latching state. Preferably the actuator acts upon the blocking member via a resiliently deformable member acting between the actuator and the blocking member whereby the resilient member can deflect should the blocking member be obstructed to avoid excessive loading on the actuator.

12 Claims, 3 Drawing Sheets

U.S. PATENT DOCUMENTS

| | | | | |
|---|---|---|---|---|
| 6,481,124 | B1 | 11/2002 | Miller et al. | |
| 6,902,346 | B2 * | 6/2005 | Steig et al. | 403/322.3 |
| 7,306,395 | B2 | 12/2007 | Fatemi | |
| 7,426,796 | B2 * | 9/2008 | Cunningham et al. | 37/468 |
| 7,493,712 | B2 | 2/2009 | McCormick et al. | |
| 7,549,243 | B1 | 6/2009 | Gilles | |
| 7,648,305 | B2 | 1/2010 | Beales | |
| 7,984,575 | B2 * | 7/2011 | Robl et al. | 37/468 |
| 7,984,576 | B2 | 7/2011 | Miller et al. | |
| 2002/0071754 | A1 | 6/2002 | Fatemi | |
| 2004/0255774 | A1 | 12/2004 | Hill | |
| 2005/0169703 | A1 | 8/2005 | Fatemi | |
| 2005/0214105 | A1 | 9/2005 | Steig, Jr. et al. | |
| 2007/0157492 | A1 | 7/2007 | Miller et al. | |
| 2007/0166143 | A1 | 7/2007 | Hart et al. | |
| 2007/0199214 | A1 | 8/2007 | McCormick et al. | |
| 2009/0282712 | A1 | 11/2009 | Pruszynski | |
| 2010/0061799 | A1 | 3/2010 | Hill | |
| 2010/0067982 | A1 | 3/2010 | Hill | |
| 2011/0088795 | A1 | 4/2011 | Hill | |
| 2011/0091267 | A1 | 4/2011 | Hill | |

FOREIGN PATENT DOCUMENTS

| | | | |
|---|---|---|---|
| FR | 2914932 | A1 | 10/2008 |
| GB | 897384 | | 5/1962 |
| GB | 1586621 | | 3/1981 |
| GB | 2330570 | A | 4/1999 |
| GB | 2332417 | A | 6/1999 |
| GB | 2450127 | A | 12/2008 |
| JP | 57155168 | A | 9/1982 |
| KR | 20010019689 | A1 | 3/2001 |
| NZ | 220 557 | A | 2/1991 |
| WO | WO 98/40569 | A1 | 9/1998 |
| WO | WO 2005/026454 | A1 | 3/2005 |
| WO | WO 2008/031590 | A2 | 3/2008 |

OTHER PUBLICATIONS

International Search Report for PCT Application No. PCT/EP2007/007974 mailed May 27, 2008, which is the international counterpart to U.S. Appl. No. 12/440,948.

Written Opinion of the International Searching Authority for PCT Application No. PCT/EP2007/007974 mailed May 27, 2008, which is the international counterpart to U.S. Appl. No. 12/440,948.

European Search Report for Application No. EP 09 01 1452 completed Nov. 20, 2009, which is a foreign counterpart to U.S. Appl. No. 12/555,476.

* cited by examiner

COUPLER

FIELD OF THE INVENTION

The present invention relates to couplers for coupling an attachment, such as an excavating bucket, to the arm of an excavator. The invention relates particularly to couplers that are powered, especially hydraulically powered.

BACKGROUND TO THE INVENTION

Hydraulic couplers for quickly connecting and disconnecting construction attachments from excavating equipment are well known. A major problem with existing couplers is that a failure of the primary locking force, typically a hydraulic failure, can cause the attachment to swing or even completely detach from the coupler posing a safety hazard. Another problem is operator misuse or accidental operation of the coupler again leading to a safety hazard. Safety devices are fitted to couplers which prevent the attachment separating from the coupler in the event of a failure of the coupler or its associated locking components. However in all couplers there is little or no indication of a failure having taken place. Most of the couplers using a device to power the lock on the front pin receiving aperture use either a direct connection between the main actuator, which is normally a hydraulic cylinder, and the front lock or a separate hydraulic cylinder to actuate the front lock. Some couplers also use a linkage from the rear hook to actuate the front lock. The problem with all of these designs is that the front hook will retract when the cylinder is actuated. The use of a gravity pendulum device was disclosed in European Patent Application EP 2161378, which meant that the front lock would only be released in a certain coupler orientation. However for this pendulum device to work effectively it required the use of two hydraulic cylinders. An additional small bore hydraulic cylinder is fitted in the coupler to operate the front lock.

SUMMARY OF THE INVENTION

According to the present invention there is provided a coupler for an excavator, the coupler comprising a body having first and second recesses for receiving first and second pins, respectively, of an attachment; a latching member movable into and out of a latching state in which it at least partially or fully closes said second pin-receiving recess; and a blocking member movable into and out of a blocking state in which a portion of the blocking member at least partially closes said first recess, actuating means for moving said first latching member into and out of said latching state, said actuating means acting indirectly upon said blocking member to move said blocking member into and out of its blocking state as the latching member is moved into and out of its latching state.

Preferably said actuating means acts upon said blocking member via a resiliently deformable member acting between the actuating means and the blocking member whereby said resiliently deformable member can deflect should the blocking member be obstructed to avoid excessive loading on the actuating means.

In one embodiment said actuating means comprises a linear actuator having a first end coupled to the body of the coupler and a second end coupled to the latching member, the actuator and latching member being mounted such that the actuator pivots about its first end as the actuator is extended to move the latching member towards its latching state, altering the orientation of the actuator relative to the body of the coupler, the resiliently deformable member acting between the actuator and the blocking member whereby said change in orientation of the actuator causes that the blocking member to be urged towards its blocking state by means of the resiliently deformable member as the latching member moves towards its latching state under the action of the actuator.

Said pivotal movement of the actuator about its first end as the actuator is extended may cause at least a portion of the body of the actuator to be displaced towards the first recess.

Preferably the first end of the actuator is pivotally mounted on the body of the actuator adjacent the first recess, said latching member being pivotally mounted on the body of the actuator adjacent said second recess, the second end of the actuator being pivotally mounted on the latching member such that extension of the actuator moves the latching member towards its latching state.

The resiliently deformable member may comprise an elongate rod or bar having a first end mounted on or abutting said actuator and a second end mounted on or abutting said blocking member, wherein said deformable member extends substantially perpendicular to the direction of movement of the blocking member into and out of its blocking state. Preferably said resiliently deformable member extends substantially parallel to the actuator. The first end of the resiliently deformable member may be mounted on the actuator at or adjacent the first end of the actuator. The resiliently deformable member preferably extends towards the second end of the actuator, a distal end of the resiliently deformable member acting on the blocking member.

In preferred embodiments, said actuating means comprises an actuator, especially a linear actuator such as a ram, in particular a hydraulic ram, coupled to said latching member and arranged to actuate said latching member into and out of its latching state. Conveniently, said actuator is connected to the first latching member such that it acts directly thereon.

Advantageously, said actuator is provided with resilient biasing means arranged to urge said actuator into a state that corresponds with the latching state of the latching member. Typically, the actuator is arranged to hold said latching member in its latching state when in an extended state, and so the resilient biasing means is arranged to urge said actuator into its extended state. Conveniently, the resilient biasing means comprises a spring, for example a compression spring. Typically, the force exerted by the resilient biasing means is less than the force exerted by the actuator. Hence, failure of the actuator may allow movement of the first latching member against the bias of the resilient biasing means.

In preferred embodiments, at least one of the latching member and the blocking member are pivotal with respect to the body. Typically, at least one of the latching member and blocking member comprises a hook.

In the preferred embodiment, a blocking lever is mounted on the body and is movable into and out of a blocking state in which it is capable of obstructing the blocking member to prevent the blocking member from moving out of its blocking state.

Preferably, said blocking lever, which conveniently takes the form of a bar, is pivotally mounted on the body. In the preferred arrangement, the blocking lever hangs substantially vertically from a pivot point under the influence of gravity, the pivot point, preferably, being located substantially above said first recess when the coupler is in a normal working orientation.

Additionally a resiliently deformable member may be coupled to the blocking lever and arranged to engage with an arm of said excavator such that the action of the resiliently deformable member when engaged with the arm biases the blocking lever into its blocking state.

Preferably said latching member, when in the latching state, defines, or is movable to define, together with its respective recess, a station for said respective pin, said station being shaped and dimensioned to allow movement of said respective pin with respect to the coupler body, and wherein, in a first mode of use in which said latching member adopts said latching state, said respective pin is held under the action of said actuating means in a first position with respect to the body of the coupler, and in response to a failure or part failure of said actuating means, said respective pin is movable to said station.

When in said station, movement of the pin with respect to the coupler body creates a movement that is detectable by the operator and may be interpreted as an indication of failure of the actuating means.

In preferred embodiments, failure or part failure of said actuating means causes said latching member to move, conveniently in a direction towards its non-latching state (although while still maintaining its latching state), and said movement of said latching member allows the, or each, attachment pin, as applicable, to move into the respective station. In such cases, the respective attachment pin is held in its first position by the first latching member, said movement of the first latching member creating the respective station for the pin. Advantageously, said first latching member is shaped to define a recess, said recess in the latching member forming, together with the respective pin-receiving recess, said respective station upon said movement of the first latching member.

Typical couplers embodying the invention provide a means of quickly attaching, retaining and detaching implements, e.g. excavating buckets, from excavators, including backhoes and similar excavating or digging equipment. Typically, the couplers include a body with two attachment points for the excavator, two recesses for receiving the attachment pins, front and rear latching members, usually in the form of hook shaped levers, and a powered actuator to move the locking members. The latching members retain the attachment pins in the front and rear recesses of the coupler respectively. Each latching member advantageously retains the pins in position in the event of loss of the main engagement force of the actuator.

In preferred embodiments, means are provided for indicating via the normal use of a coupled attachment that a failure of the primary actuator within the coupler has occurred.

This invention uses the change of angle of the main actuator preferably a hydraulic cylinder mounted to the coupler body to operate the front lock. This is achieved via the use of a resiliently deformable member connected between the cylinder and the front lock in such a way that the change of angle of the main cylinder causes the operation of the front lock. The advantage of this is that if the front lock should be obstructed when opening or closing then the deformation of the connecting resiliently deformable member will allow this without excessive loads being imposed upon the pivots or linkages of the coupler mechanism. This allows the use of the previously disclosed gravity pendulum within a coupler employing a single actuator to lock and unlock both the front and rear locking members.

Further advantageous aspects of the invention will be apparent to a skilled person upon review of the following description of a preferred embodiment and with reference to the accompanying drawings.

BRIEF DESCRIPTION OF THE DRAWINGS

An embodiment of the invention is now described by way of example and with reference to the accompanying drawings in which.

DETAILED DESCRIPTION OF THE DRAWINGS

Figure 1:
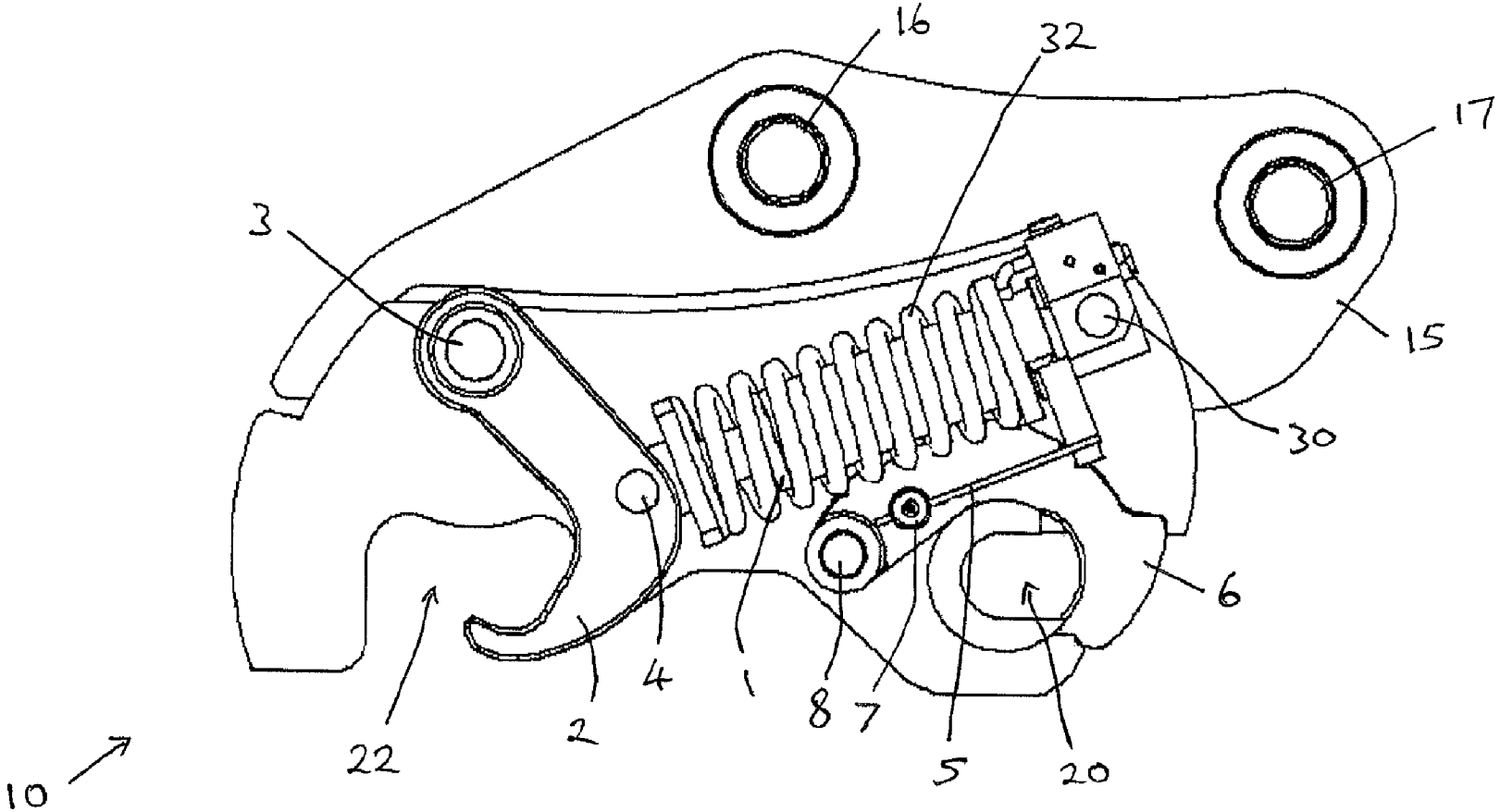
FIG. 1 is side view of a coupler embodying the invention.

Referring now to the drawings there is shown, generally indicated as 10, a coupler, or hitch, for connecting a tool, or other attachment such as a bucket, to an arm of an excavator (not shown), or other apparatus. The coupler 10 has a body typically comprising two spaced-apart side plates 15 (only one shown). The body is shaped to define pin-receiving apertures 16, 17 by which the coupler 10 may be connected to the end of the arm. Typically, there are two spaced-apart apertures 16, 17 in each of the two side plates 15, the apertures in one side plate being aligned with the apertures in the other. When connected, the coupler 10 is able to pivot with respect to the arm about the axis of the apertures 17. Usually, a hydraulic mechanism, or other power operated mechanism (not shown), is provided, typically in association with a mechanical linkage and connected via aperture 16, to pivot the coupler 10 with respect to the arm.

The body includes first and second pin-receiving recesses 20, 22 formed in each side plate 15. Each recess 20, 22 is shaped and dimensioned to receive a respective pin 26 (see FIG. 3) of a bucket or other attachment. Normally, the recesses 20, 22 face in mutually perpendicular directions. The recess 22 may be wider than is necessary to receive a single pin in order to accommodate attachments with different pin spacings.

The coupler 10 also includes a first power-operated latching mechanism typically comprising a latching member 2 in the preferred form of a hook, and an actuator 1 typically in the form of a linear actuator such as a hydraulic ram. Other forms of powered actuator could be used (e.g. pneumatic or electrically operated) but hydraulic is convenient because excavators typically have a hydraulic system available at or near the end of the arm. The latching member 2 and actuator 1 are provided between the side plates 15. The latching member 2, which may comprise one or more aligned hook elements, is pivotally mounted on the body at pivot 3 in any convenient manner and is pivotal about an axis that runs substantially perpendicular to the body/plates 15. The latching member 2 is pivotal between an open, or non-latching, state (shown in FIG. 2) and at least one latching state (shown in FIG. 3). In the open state, the latching member 2 allows a respective pin to be inserted into or removed from the recess 22. In the latching state, the latching member 2 prevents the pin from being removed from the recess 22. For example, in FIG. 2, the latching member 2 is shown in the open non-latching state while in FIG. 3 the latching member 2 is shown in its latching state. In its latching state the latching member 2 may partially or fully close the recess 22.

Figure 2:
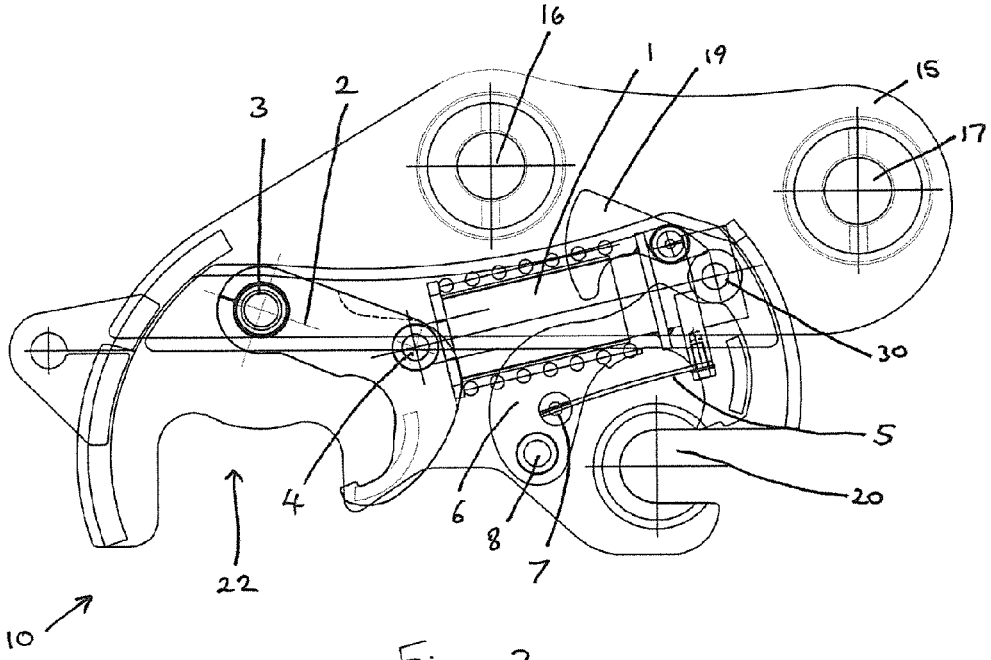
FIG. 2 is a side view of the coupler of FIG. 1 showing the latching member and blocking member in their respective open states.
Figure 3:
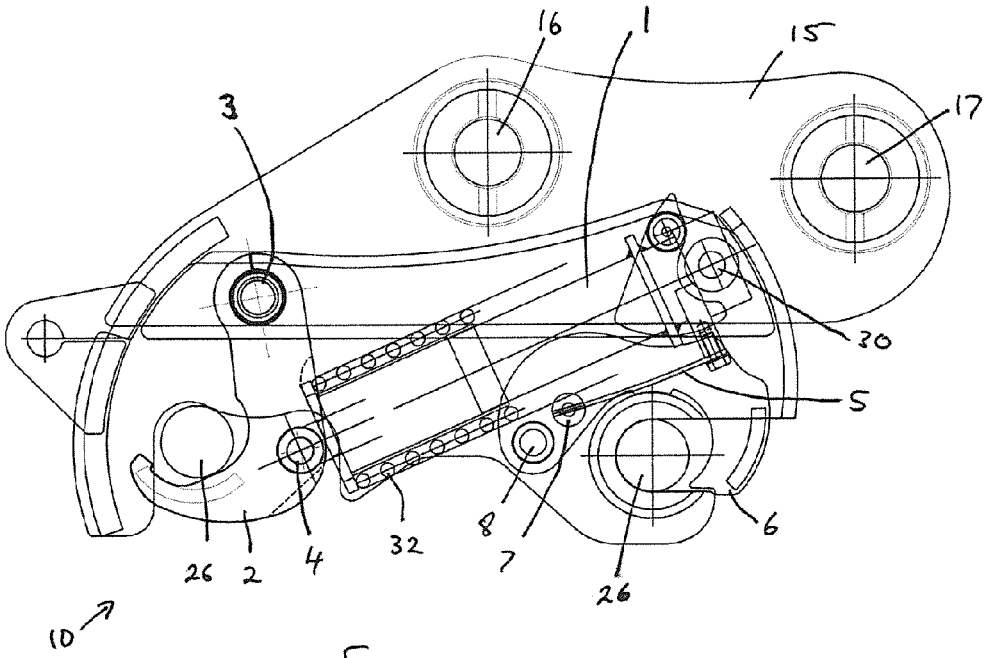
FIG. 3 is a side view of the coupler of FIG. 1, showing a latching member and blocking member in their respective latching and blocking states.

The coupler 10 further includes a front blocking member 6, in the preferred form of a hook, for retaining an attachment pin in the recess 20. The blocking member 6 is pivotally mounted on the body in any convenient manner, e.g. pin or bearing, at pivot point 8. The blocking member 6 is pivotal about an axis substantially perpendicular to the side plates 15 between an open state (FIG. 2) and a blocking state (FIG. 3). In the open state, the blocking member 6 is clear of the recess 20 to the extent that it does not prevent the respective pin from being removed from the recess 20, while in the blocking state, the blocking member 6 prevents the pin from being removed from the recess 20. In the preferred embodiment, the blocking member 6 includes a jaw that, in the blocking state, substantially, or at least partly, closes the otherwise open mouth of the recess 20. In alternative embodiments, the blocking member 6 may be slidably mounted on the body, or otherwise movable between the open state and the blocking state(s), without necessarily being pivotal. Further, the blocking member 6 need not necessarily take the form of a hook.

Typically, the actuator 1 comprises a piston housing and a piston rod, the rod being actuatable into and out of the housing in a reciprocating manner. In the preferred embodiment, the free, or leading, end of the piston rod is pivotally connected to the latching member 2, the pivoting movement being about a respective axis 4 that is substantially perpendicular to the plates 15. A rear end of the piston housing is pivotally connected to the housing for pivotal movement about a respective pivot axis 30 adjacent the recess 20. When the piston rod adopts a retracted state, or relatively retracted state, the latching member 2 adopts its open state as shown in FIG. 2. When the piston rod is extended, the latching member moves towards its latching state, as shown in FIG. 3. Depending on the location of the respective pin 26 in the recess 22, the amount by which the piston rod is extended when the latching member 2 reaches its latching state can vary. Conveniently, the actuator 1 is operable via the excavator's hydraulic system (not shown), the controls typically being located in the cab of the excavator.

Advantageously, resilient biasing means, conveniently in the form of a spring 32 may be provided on the actuator 1 and arranged to resiliently bias the actuator 1, and in particular the piston rod, into its extended position. The spring 32 may take the form of a compression spring. The spring 32 is shown externally of the actuator 1. Alternatively, the spring 32, or other resilient biasing means, may be fitted internally of the piston housing. The biasing means may be a mechanical spring as illustrated but may take any suitable alternative form, e.g. a gas spring. The purpose of the spring 32 is to hold the actuator 1 in its extended state and so to hold the latching member 2 in a forward or latching state in the event of the loss of actuating force from the actuator 1 due, for example, to a hydraulic or mechanical failure of the actuator 1 or its supply. This may be regarded as a redundant safety back up to the extension force of the actuator 1. In use, the actuator 1 together with the spring 32, when present, provide a primary actuating force that serves to hold the first latching member 2 in its latching state.

In preferred embodiments, the coupler 10 includes a gravity-actuated blocking member in the preferred form of a pivotally mounted blocking lever 9 (see FIGS. 2 and 3) and is movable between a blocking state and a non-blocking state depending upon the orientation of the coupler body. In the blocking state, the blocking lever 9, or at least its free end, lies in the path of the blocking member 6 such that it prevents the blocking member 6 from moving from its blocking state to its open state. The blocking lever 9 is pivotal with respect to the coupler body between the blocking and non-blocking states under the action of gravity.

In the preferred embodiment, the arrangement is such that the blocking lever 9 is located over the front pin receiving recess 20 when the coupler body is in a normal operating orientation during use of the attachment mounted thereon so that the blocking lever 9 hangs substantially vertically in the blocking state to prevent movement of the blocking member 6 away from its blocking state. It is also preferred that a gap is left between the free end of the blocking lever 9 and the blocking member 6 when the blocking lever is in its blocking state to obviate the risk of the blocking lever jamming against the blocking member during use by, for example, dirt or other foreign matter. The gap also provides a self-cleaning effect whereby the movement of the blocking lever 9 swinging into and out of its blocking state during the normal use of the coupler, will tend to prevent any build up of debris on the of the blocking member 6. Further, the gap between the blocking lever 9 and the blocking member 6 is advantageous in that it allows some flexibility in the operation of the coupler 10: should the operator initiate the withdrawal of the blocking member 6 before pivoting the coupler 10 into a different orientation, then provided he initiates the pivoting of the coupler a short time later, the blocking member 6 will not be blocked by the blocking lever 9.

In the event of a failure of the primary latching force to the first latching member 2, e.g. in the event of a hydraulic failure of the actuator 1, in a coupler orientation where the attachment will have a tendency to try to escape from the front recess 20 due to the action of gravity, the blocking member 6 is locked in position mechanically by the position of the gravity-actuated blocking lever 9. To ensure that the blocking lever is in position to block any movement of the blocking member 6, especially in cases where gravity tends to urge the front attachment pin from recess 20, the blocking lever 9 may be provided with a resiliently deformable member (not shown) arranged to engage with an arm of an excavator or other machine to which the coupler is mounted during use in certain orientations. In particular, it is preferably arranged to engage with the dipper arm (or other part) of the excavator when the coupler is in the full curl or dump position. The arrangement is such that the action of the resiliently deformable member when engaged with the arm will bias the gravity blocking lever 9 into its blocking state, thereby preventing movement of the blocking member 6 away from its blocking state. Conveniently, when the blocking lever is in the non-blocking state, its position is determined by a mechanical stop against which it comes to rest.

In the preferred embodiment the actuator 1 acts indirectly upon the blocking member 6 via a resiliently deformable member 5. The resiliently deformable member 5 is conveniently connected to or acts against (directly or indirectly) the blocking member 6 at one end as is connected to or acts against the actuator 1 at an opposite end. In the embodiment shown in FIGS. 2 and 3, the resiliently deformable member 5 is mounted on an extension of the piston housing of actuator 1. This extension is shown as being close to pivot 30 of actuator 1 but may be positioned in any suitable position along the length of actuator 1. This resiliently deformable member 5, in the form of a rod or bar of resilient material, such as spring steel, extends substantially parallel to the piston rod of the actuator 1 to engage a portion of the blocking member 6. In the embodiment shown, the resiliently deformable member 5 comprises an elongate strip formed from spring steel having a retained end attached to the extension of the piston housing of actuator 1 and a section which may be straight or curved or any combination extending therefrom to pass through a receiving aperture in a member 7. Member 7 may be pivotally mounted on front blocking member 6 or alternatively permanently fixed to front blocking member 6 such that any movement of the resiliently deformable member 5 is transferred into front blocking member 6. By way of example, the resiliently deformable member 5 may comprise a leaf spring.

As the actuator 1 extends, this causes latching member 2 to rotate around its fixed pivot point 3. This rotation of the latching member 2 combined with the extension of actuator 1 causes the angle of the actuator 1 within the coupler body to change as the piston rod follows the arc described by its attachment point 4 to latching member 2. This change in angle is translated via the resiliently deformable member 5 into a vertical movement of the deformable members attachment point 7 to the front blocking member 6. The result of this is that the front blocking member 6 is caused to rotate around its pivot 8 to the coupler body. The mechanism is designed such that extension of the actuator 1 will cause the front blocking member 6 to move to its blocking position closing the front pin receiving recess 20 of the coupler. Equally, retraction of the actuator 1 will cause the front blocking member 6 to move to a position clear of the front pin receiving recess 20 effectively opening the front recess 20 of the coupler An additional benefit of the use of the resiliently deformable member 5 is that, should the movement of the front blocking member 6 be obstructed e.g. by the gravity blocking lever 9 previously described, then the movement caused by the change in extension of the actuator 1 will cause a deformation of the resiliently deformable member 5 and not impose any excessive loading upon any pivots or linkages within the coupler mechanism.

Figure 4:
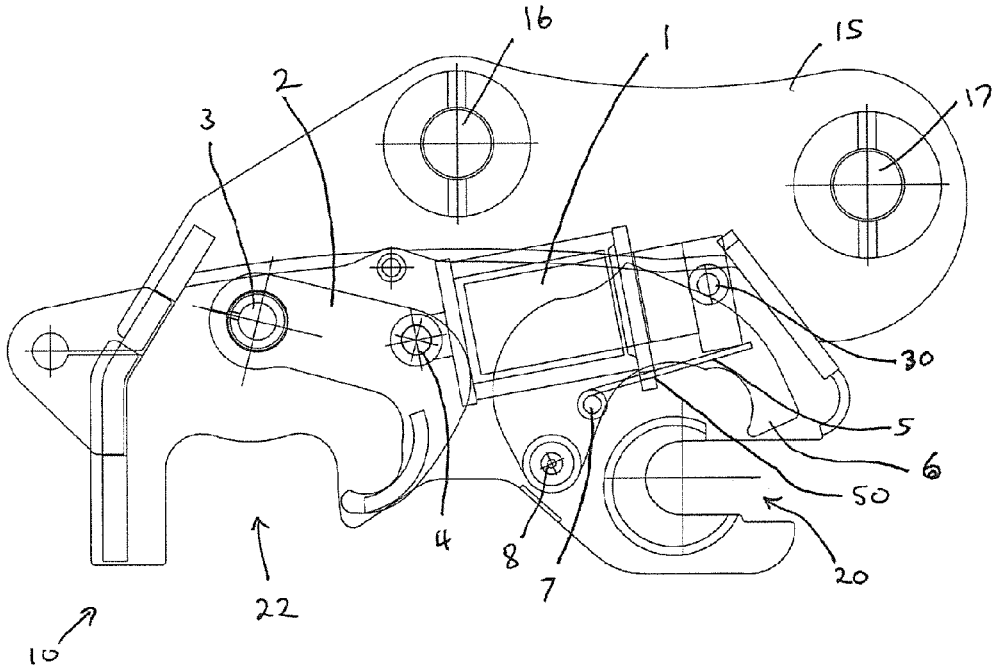
FIG. 4 is a sectional side view of a coupler in accordance with a further embodiment of the invention.
Figure 5:
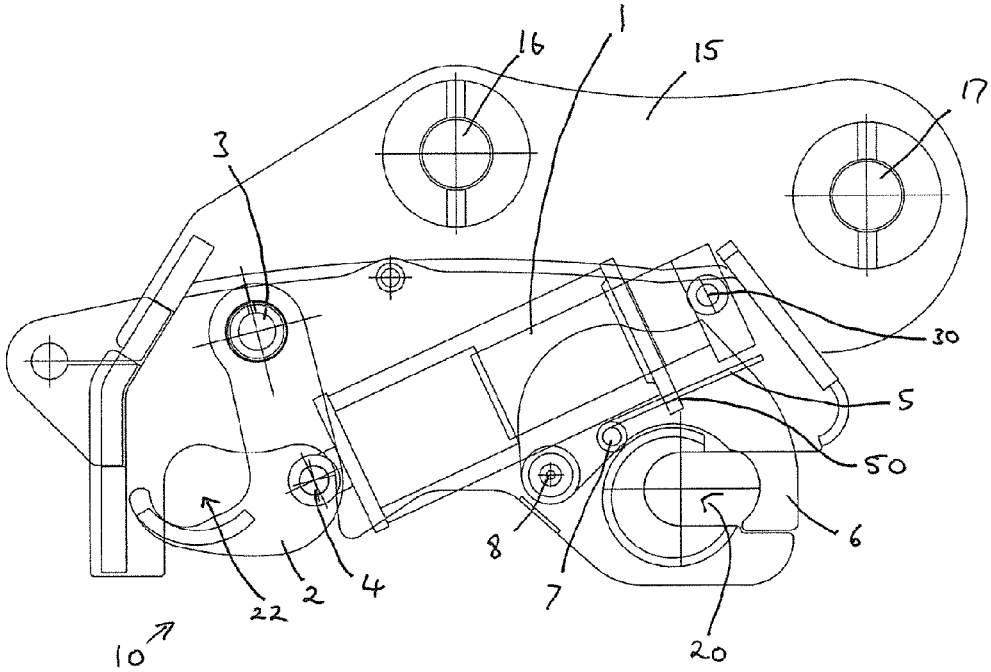
FIG. 5 is a side view of the coupler of FIG. 4 showing the latching member and blocking member in their respective latching and blocking states.

In an alternative embodiment, illustrated in FIGS. 4 and 5, the resiliently deformable member comprising an elongate strip or rod, for example formed from spring steel, having a retained (e.g. coiled) end attached to the mounting pin 7 of the latching member 2 and a straight section extending therefrom and passing through a receiving aperture 50 formed in a projection provided on the actuator body. A distal end of the straight section of the resiliently deformable member 5 may abut against a side of the actuator 1 adjacent its pivot point 30.

The invention is not limited by the embodiment described herein, which may be modified or varied without departing from the scope of the invention.

The invention claimed is:

1. A coupler for an excavator, the coupler comprising a body having first and second recesses for receiving first and second pins, respectively, of an attachment; a latching member movable into and out of a latching state in which it at least partially closes the second pin-receiving recess; and a blocking member movable into and out of a blocking state in which a portion of the blocking member at least partially or fully closes the first recess, an actuator for moving the latching member into and out of its latching state, the actuator acting indirectly upon the blocking member to move the blocking member into and out of its blocking state as the latching member is moved into and out of its latching state, wherein the actuator acts upon the blocking member via a resiliently deformable member acting between the actuator and the blocking member, wherein the actuator comprises a linear actuator, having a first end directly coupled to the body of the coupler and a second end directly coupled to the latching member, wherein the latching member and/or the blocking member comprises a hook pivotally coupled to the body of the coupler and wherein the blocking member is pivotally coupled to the body of the coupler at a location between the first and second recesses.

2. A coupler as claimed in claim 1, wherein the actuator further comprises a body, the actuator and latching member being mounted such that the actuator pivots about its first end as the actuator is extended to move the latching member towards its latching state, altering the orientation of the actuator relative to the body of the coupler, the resiliently deformable member acting between the actuator and the blocking member whereby such change in orientation of the actuator causes the blocking member to be urged towards its blocking state by means of the resiliently deformable member as the latching member moves towards its latching state under the action of the actuator.

3. A coupler as claimed in claim 2, wherein the pivotal movement of the actuator about its first end as the actuator is extended causes at least a portion of the body of the actuator to be displaced towards the first recess.

4. A coupler as claimed in claim 2, wherein the first end of the actuator is pivotally mounted on the body of the coupler adjacent the first recess, the latching member being pivotally mounted on the body of the actuator adjacent the second recess, the second end of the actuator being pivotally mounted on the latching member such that extension of the actuator moves the latching member towards its latching state.

5. A coupler as claimed in claim 2, wherein the resiliently deformable member comprises an elongate rod or bar having a first end mounted on or abutting the actuator and a second end mounted on or abutting the blocking member, wherein the deformable member extends substantially perpendicular to the direction of movement of the blocking member into and out of its blocking state.

6. A coupler as claimed in claim 5, wherein the resiliently deformable member extends substantially parallel to the actuator.

7. A coupler as claimed in claim 5, wherein the first end of the resiliently deformable member is mounted on the actuator at or adjacent the first end of the actuator.

8. A coupler as claimed in claim 7, wherein the resiliently deformable member extends towards the second end of the actuator, a distal end of the resiliently deformable member acting on the blocking member.

9. A coupler as claimed in claim 1, wherein the actuator comprises a hydraulic ram.

10. A coupler as claimed in claim 1, wherein a blocking lever is mounted on the body and is movable into and out of a blocking state in which it is capable of obstructing the blocking member to prevent the blocking member from moving out of its blocking state.

11. A coupler as claimed in claim 10, wherein the blocking lever is pivotally mounted on the body of the coupler.

12. A coupler as claimed in claim 11, wherein the blocking lever hangs substantially vertically from a pivot point under the influence of gravity, the pivot point being located substantially above the first recess when the coupler is in a normal working orientation.

* * * * *